United States Patent [19]

Shenton

[11] Patent Number: 4,780,091

[45] Date of Patent: Oct. 25, 1988

[54] TWO-PART ELECTRICAL CONNECTOR

[75] Inventor: Kenneth Shenton, Milton Keynes, England

[73] Assignee: GEC Avionics Limited, England

[21] Appl. No.: 54,489

[22] Filed: May 27, 1987

[30] Foreign Application Priority Data

Jun. 6, 1986 [GB] United Kingdom ..... 8613824

[51] Int. Cl.[4] ..... H01R 13/52

[52] U.S. Cl. ..... 439/272; 439/587

[58] Field of Search ..... 439/271, 272, 273, 274, 439/275, 276, 277, 278, 279, 280, 281, 282, 283, , 587, 589, 592

[56] References Cited

U.S. PATENT DOCUMENTS

| | | | |
|---|---|---|---|
| 2,619,515 | 11/1952 | Doane | 439/274 |
| 3,425,024 | 1/1969 | Moulin | 339/63 |
| 3,597,724 | 8/1971 | Phillips | 439/272 |
| 3,678,441 | 7/1972 | Upstone et al. | 439/272 |
| 3,792,416 | 2/1974 | Moulin | 339/94 R |
| 3,922,477 | 11/1975 | Glowacz | 439/271 |
| 4,193,655 | 3/1980 | Herrmann, Jr. | 439/271 |
| 4,695,259 | 9/1987 | Uchida | 439/271 |

*Primary Examiner*—David Pirlot

*Attorney, Agent, or Firm*—Kirschstein, Kirschstein, Ottinger & Israel

[57] ABSTRACT

A multi-pin plug and socket electrical connector in which adjacent pins are sealed from each other at the interface by an elastomeric sheet. The sheet extends over the entire interface with each pin extending through a hole in the sheet. Each hole is surrounded by a O-ring integral with the sheet. The sheet may extend within each O-ring to make contact with the pin. The pins are sealed at their opposite, i.e. wire ends by individual elastomeric seals in the pin bores.

7 Claims, 4 Drawing Sheets

TWO-PART ELECTRICAL CONNECTOR

BACKGROUND OF THE INVENTION

1. Field of the Invention

This invention relates to two-part multiple contact electrical connectors of the kind in which each part comprises a block of insulating material having multiple bores each housing a male or female pin. The 'rear' end of each pin is connected, by soldering, crimping or similar method, to an insulated wire connector.

2. Description of Related Art

Certain classes of such connectors, used for example in military radar systems must be of a very high standard and must therefore be well sealed against the environment to prevent conductive fluids coming into contact with conductive parts of the connector and causing short circuiting. Adjacent bores in each block are therefore sealed from each other at the interface of the two connector parts. The rear faces of the blocks may be in an enclosed environment at non-atmospheric pressure or may be open to the atmosphere. In the former case a rear-end seal is preferably employed in each bore to relieve the pressure differential on the interface seal, and in the latter case a rear-end seal will tend to prevent short circuiting across the rear face. In the case of the exposed rear face the rear-end seal would of course be continuous with the insulation on the wire conductor. One system of seals is disclosed in U.K. Pat. No. 1406161 which uses three individual pressure sensitive seals for each contact pair—one at the rear end of each contact and one at the interface.

A single interface seal for the whole array of contacts is disclosed as prior art in the above patent specification. A flat sheet having a hole for each contact pair is disposed between the mating faces of the plug and socket connector parts. At the edge of each hole a step is formed in the sheet so that a square rim of thicker material surrounds each hole. This rim is designed to fit within the mating bores and closely against the contact when the connector is assembled, protruding a short distance into each of the bores. The sheet is in sealing contact with the flat mating faces across its entire surface between adjacent holes, but to maintain sufficient compression of the sheet to give an effective seal the connector parts must be clamped together under great pressure. In case of failure of this, because of insufficient clamping pressure for example, the bores are protected to some extent by the thickened rim around the hole. However this leads to a further problem that if this rim is to provide an effective seal it must be tightly compressed against the bore surfaces, that is, the contact must be a tight fit through the hole. On assembly, therefore, the rims of the holes are liable to damage by insertion of the contacts, and the contacts—generally thin pins requiring precise alignment for a good electrical connection in their respective sockets—may themselves be liable to be bent.

SUMMARY OF THE INVENTION

An object of this invention is to alleviate some of these problems.

According to the present invention a two-part electrical connector comprises first and second parts each housing a set of longitudinal conductive elements in respective insulating bores, conductive elements of one set being arranged to mate with respective conductive elements of the other set to form electrical connections when the two parts are brought together, and an insulating elastomeric sheet arranged to be disposed at the interface between the parts and having a hole for each connecting pair of elements, each said hole being surrounded by an O-ring integral with the sheet so that, in use, adjacent connecting pairs of elements are sealed from each other across the interface. The sheet may extend within each O-ring so that, in use, the sheet is in contact with each connecting pair of elements. The sheet may extend beyond the interface around and in close contact with the sides of one part such that the sheet is supported by that part.

An elastomeric insulating seal is preferably disposed towards the rear end of each bore distant from the interface to surround each conductive element in sealing contact with the conductive element and having at least one annular ridge in sealing contact with the bore. Alternatively or additionally the seal may have at least one annular ridge in sealing contact with the conductive element. The seal may be so shaped as to clip into a recess in the conductive element, or to engage a retaining shoulder on the conductive element.

BRIEF DESCRIPTION OF THE DRAWINGS

One embodiment of the connector in accordance with the invention will now be described, by way of example, with reference to the accompanying drawings, of which.

DETAILED DESCRIPTION OF THE PREFERRED EMBODIMENTS

Figure 1:
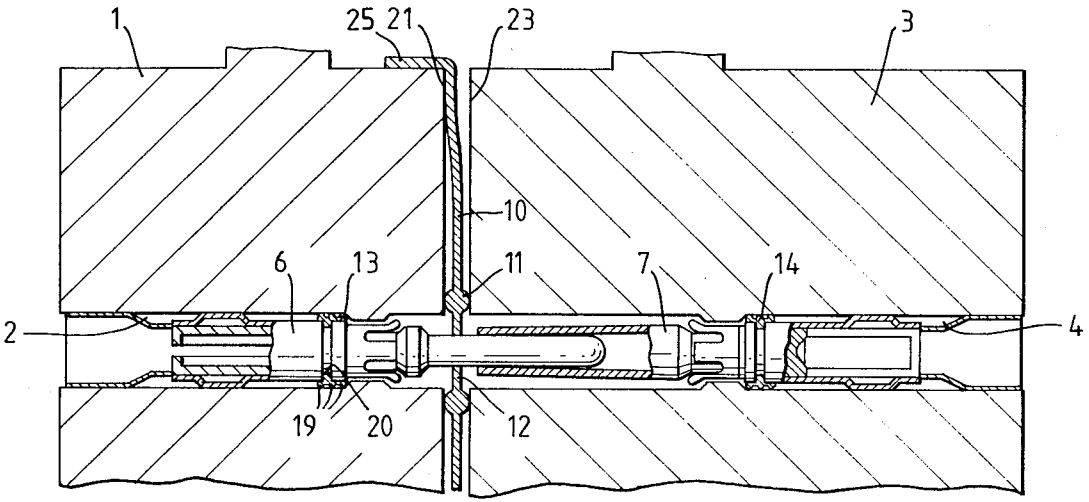
FIG. 1 shows a portion of an assembled connector, partially in section.

FIG. 1 shows a portion of a connector having a plug part 1 and a socket part 3 which hold male and female pins respectively. Only one male pin 6 and its interconnecting female pin 7 is shown but the connector actually holds an array of many pairs of pin contacts (see FIG. 3). The pins are disposed in bores 2, 4 and are sealed from the environment by rear end seals 13, 14 and at the connector interface by an interface seal 10.

Each connector part 1, 3 is made of a rigid insulating material. The pin contacts may be of various types and by way of example FIG. 1 shows a plain contact pin and socket. The plain contact male pin 6 is disposed in bore 2, and its mating plain contact female pin 7 in bore 4. The rear end of each pin is protected by the individual elastomeric seal 13, 14. When the plug and socket parts 1, 3 are brought together in alignment respective pins engage across the interface between the two parts. Protection of this interface is provided by the insulating elastomeric sheet 10. This single sheet extends over the entire interface and has a hole for each contact pair. An O-ring 11 which is integral with the sheet, surrounds each hole and is located so that it is in sealing contact with the mating faces 21, 23 of the two parts 1 and 3. The expanses of the sheet between the O-rings 11 need not be in contact with the mating faces since sealing is provided by means of the O-rings. The pressure required to compress the O-rings against the mating faces is substantially less than would be required to maintain sealing contact of a flat sheet across the entire interface, so the parts 1, 3 are not required to be clamped together under high pressure. A clamping pressure of 55 to 60 psi is typically sufficient. Strain at the clamping means (not shown), which could lead to component failure or reduced sealing, is therefore lessened.

The exact location of each O-ring, that is, its diameter, is not vital provided that it is in contact with both faces 21, 23, which should be flat for a good seal. A narrow annular strip 12 of the elastomeric sheet extends within each O-ring 11 to make contact with the pin 6 at the interface. This strip provides sealing to some extent between the plug bores and their respective socket bores. It is sufficiently flexible not to impede insertion of the contacts in any way.

Each pair of contacts is thus sealed at the interface from the environment and from each adjacent pair. If the seal fails at one of the outer pairs in the array, for example, if the O-ring around that pair is corroded, that connection will be liable to invasion by fluids from the environment, but since all the other contact pairs are sealed independently these connections are still protected.

The pins must also be protected from fluids entering the bores from the rear faces of the connector parts 1, 3. An insulating elastomeric rear seal 13, 14 is fitted over the pin end overlapping the insulated portion of the wire leading from the pin. The seal 13, 14 is in close contact with the pin 6, 7 and has a series of annular ridges 19 in sealing contact with the bore. An internal collar 20 on the seal fits into a recess on the contact. This makes it easier to locate the seal correctly on assembly. The particular location of the rear seal 13, 14 is different for different pin types but the seal must always at least partially overlap the insulated portion of the pin or wire, so that fluids entering at the rear end of the bore 2, 4 are prevented from reaching any conductive part of the pin. The seal is slipped onto the pin prior to assembly of the connector, the collar 20 clipping into the appropriate recess. Alternatively the seals could be moulded onto the pins as part of the pin manufacturing process. Annular ridges may be provided additionally, or alternatively, on the inner surface of the seal to make sealing contact with the pin or insulated wire.

Figure 2A:
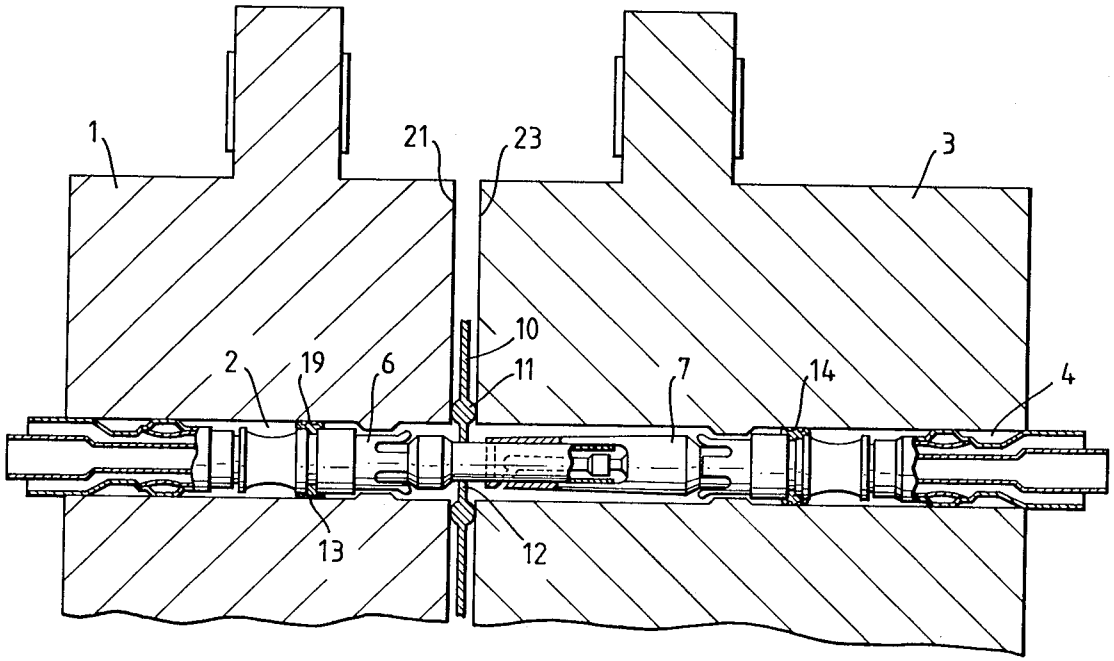
FIGS. 2*a* and 2*b* show different contact types for use with the connector.
Figure 2B:
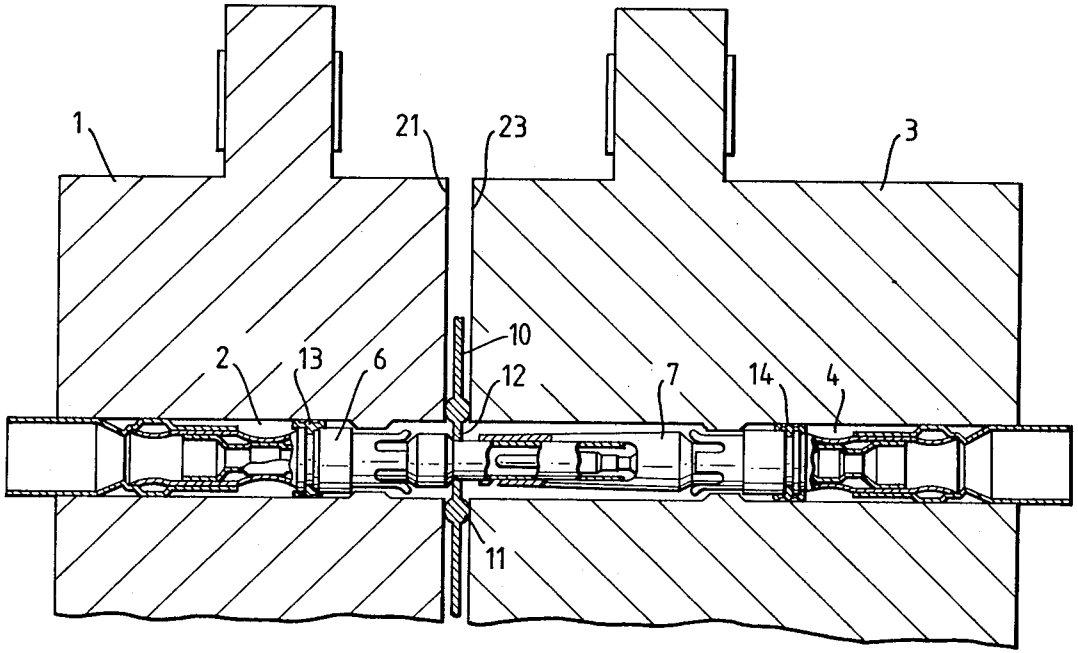

FIGS. 2*a* and 2*b* show alternative contact types suitable for use with the invention. FIG. 2*a* shows a shielded contact pin and socket twisted pair, FIG. 2*b* shows a shielded contact pin and socket coaxial pair. Corresponding parts are labelled as in FIG. 1.

Figure 3:
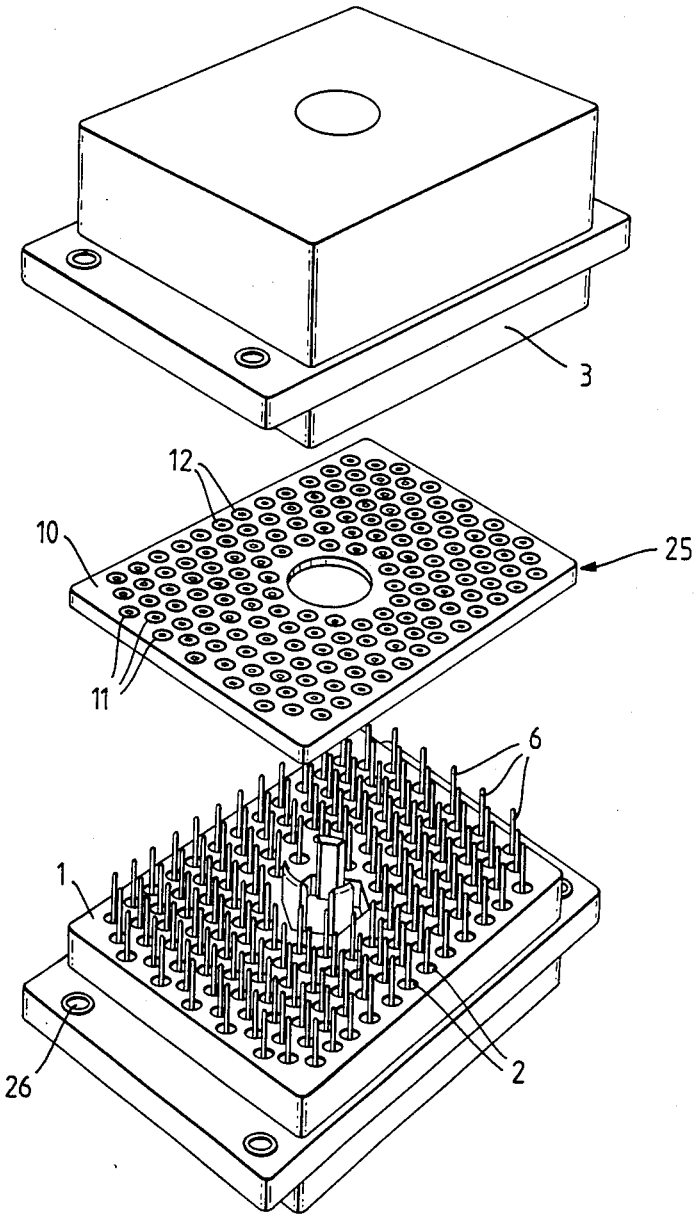
FIG. 3 shows the components of the connector before assembly.

FIG. 3 shows an exploded view of the whole connector. An array of male pins 6 is held in plug part 1 for connection with a corresponding array of female pins (not shown) in socket part 3. Before the two parts are connected the interfacial elastomeric seal 10 is placed over the male pin array. Each pin 6 is surrounded by an O-ring 11 and a narrow extension 12 of the sheet 10, and the sheet extends beyond the area of the interface to form a rim 25 which fits snugly over the sides of the pin connector part 1, as shown in FIG. 1. The sheet 10 is assembled to the plug part 1 before the pins are inserted so as to avoid distorting them. A rectangular connector and pin array are shown here but the invention may be used for other, for example circular, pin formations or connector parts.

After assembly and coupling of the plug and socket, the two parts 1, 3 are clamped together by screws and threaded holes 26.

I claim:

1. A two-part electrical connector, comprising: first and second parts each having insulating bores; first and second sets of longitudinal conductive elements housed in respective ones of said insulating bores, conductive elements of one set mating with respective conductive elements of the other set to form electrical connections when said parts are brought together, an interface being defined between said parts in use; an insulating elastomeric sheet disposed at the interface between said parts, each connecting pair of elements extending through a respective hole in said sheet; and an O-ring surrounding each hole, each said O-ring being integral with said sheet and of greater thickness than said sheet such that said O-ring stands proud of said sheet on both sides of said sheet, so that, in use, adjacent connecting pairs of elements are sealed from each other across the interface.

2. A two part electrical connector according to claim 1 wherein said sheet extends within each said O-ring such that said sheet is in contact with each said connecting pair of elements.

3. A two-part electrical connector according to claim 1 wherein said sheet extends beyond said interface around and in close contact with the sides of one said part such that said sheet is supported by said part.

4. A two-part electrical connector according to claim 1 comprising a respective elastomeric insulating seal disposed towards the rear end of each bore distant from said interface and surrounding each conductive element said seal being in sealing contact with said bore and having at least one annular ridge in sealing contact with said conductive element.

5. A two-part electrical connector according to claim 1 comprising a respective elastomeric insulating seal disposed toward the rear end of each bore distant from said interface and surrounding each conductive element, said seal being in sealing contact with said conductive element and having at least one annular ridge in sealing contact with said bore.

6. A two-part electrical connector according to claim 5 wherein said seal is so shaped as to clip into a recess in said conductive element.

7. A two-part electrical connector according to claim 5 wherein said seal is so shaped as to engage a retaining shoulder on said conductive element.

* * * * *